US010988926B2

(12) United States Patent
Mitchell

(10) Patent No.: US 10,988,926 B2
(45) Date of Patent: Apr. 27, 2021

(54) APPARATUS COMPRISING A ROOF PANEL AND CONTROL SYSTEM FOR OPENING AND CLOSING THE ROOF PANEL

(71) Applicant: PANEL UK LTD, Leeds (GB)

(72) Inventor: Nigel Mitchell, Gomersal (GB)

(73) Assignee: PANEL UK LTD

( * ) Notice: Subject to any disclaimer, the term of this patent is extended or adjusted under 35 U.S.C. 154(b) by 285 days.

(21) Appl. No.: 16/171,015

(22) Filed: Oct. 25, 2018

(65) Prior Publication Data

US 2019/0323232 A1 Oct. 24, 2019

(30) Foreign Application Priority Data

Nov. 2, 2017 (GB) ..... 1718165

(51) Int. Cl.
*E04B 7/16* (2006.01)
*E04B 9/00* (2006.01)
(Continued)

(52) U.S. Cl.
CPC ..... *E04B 7/163* (2013.01); *E04B 9/003* (2013.01); *E04B 9/001* (2013.01); *E04B 9/02* (2013.01);
(Continued)

(58) Field of Classification Search
CPC ..... E04B 7/163; E04B 9/003; E04B 9/001; E04B 9/02; E04B 1/3483; E04B 7/166; E04B 7/16; E05F 15/611; E05F 15/72; E05Y 2201/434; E05Y 2400/612; E04H 1/125; E06B 7/098; E06B 7/084; E04D 13/0354; E04D 13/0325; E04D 13/0351; E04F 10/10
See application file for complete search history.

(56) References Cited

U.S. PATENT DOCUMENTS 3,254,451 A * 6/1966 Wills ..... E04F 10/08 49/74.1
4,128,307 A * 12/1978 Badertscher ..... E04F 10/10 359/596
(Continued)

FOREIGN PATENT DOCUMENTS

CA 2971702 A1 * 6/2016 ..... E04F 10/08
EP 3015618 A1 * 5/2016 ..... E04B 7/163
(Continued)

OTHER PUBLICATIONS

GB1718165.2 Search Report.

*Primary Examiner* — Jessie T Fonseca
(74) *Attorney, Agent, or Firm* — MacCord Mason PLLC

(57) ABSTRACT

There is provided an apparatus comprising a roof panel (20) and control system (14), the roof panel comprising one or more cover portions that are moveable between open and closed positions for opening and closing the roof panel. The control system comprises an actuator (40) for moving the cover portions between the open and closed positions, a mains power supply input, and an emergency power store. The control system is configured to receive one or more signals indicative of an emergency, to power the actuator from the mains power supply when the signals indicate there is no emergency, and to power the actuator from the emergency power store when the signals indicate there is an emergency.

16 Claims, 3 Drawing Sheets

(51) Int. Cl.
*E05F 15/611* (2015.01)
*E05F 15/72* (2015.01)
*E04B 9/02* (2006.01)

(52) U.S. Cl.
CPC ..... *E05F 15/611* (2015.01); *E05F 15/72* (2015.01); *E05Y 2201/434* (2013.01); *E05Y 2400/612* (2013.01)

(56) References Cited

U.S. PATENT DOCUMENTS 4,527,355 A * 7/1985 Numakami ..... E04F 10/10 49/275
4,926,599 A * 5/1990 Scholz ..... E04F 10/10 49/87.1
5,433,259 A * 7/1995 Faludy ..... B60P 3/343 136/245
5,733,036 A * 3/1998 Montgomery ..... F21S 8/026 362/283
7,335,096 B2 * 2/2008 Perez ..... E04B 7/163 454/358
8,413,389 B2 * 4/2013 Frigerio ..... E04F 10/10 52/75
9,175,511 B2 * 11/2015 Whytlaw ..... E06B 9/362
9,422,715 B1 * 8/2016 Selzer ..... E04D 11/00
9,903,114 B2 * 2/2018 Partridge ..... E04B 9/003
10,094,122 B1 * 10/2018 Akbulut ..... E04F 10/10
10,560,050 B2 * 2/2020 Raghunathan ..... H02S 20/26
2007/0068106 A1 * 3/2007 Mangano ..... E06B 7/08 52/473
2008/0041969 A1 * 2/2008 Nathan ..... F24F 13/06 236/49.3
2013/0199736 A1 * 8/2013 Ro ..... E06B 7/086 160/7
2013/0212946 A1 * 8/2013 Villarreal, Jr. ..... E06B 7/096 49/90.1
2013/0291438 A1 * 11/2013 Selzer ..... E04B 7/163 49/82.1
2014/0130988 A1 * 5/2014 Frigerio ..... E04F 10/10 160/138
2014/0165482 A1 * 6/2014 Tandler ..... E04D 13/033 52/200
2014/0175240 A1 * 6/2014 Selzer ..... E04F 10/10 248/237
2015/0092400 A1 * 4/2015 Vincenzi ..... H02S 40/425 362/183
2016/0115688 A1 * 4/2016 Weaver ..... E04F 10/10 52/473
2018/0313142 A1 * 11/2018 Gharabegian ..... H02S 10/12
2019/0338528 A1 * 11/2019 Torman ..... E04F 10/10

FOREIGN PATENT DOCUMENTS

FR 3042802 A1 * 4/2017 ..... E03B 3/03
GB 4244012 6/1994
GB 2321489 A * 7/1998 ..... E04D 13/033
GB 2511053 8/2014
JP 2009185490 8/2009
JP 2010121316 A * 6/2010 ..... E04F 10/10
KR 20170142665 12/2017
WO WO-2017199105 A1 * 11/2017 ..... E04B 7/163
WO WO-2020074451 A1 * 4/2020 ..... E06B 9/0676

* cited by examiner

APPARATUS COMPRISING A ROOF PANEL AND CONTROL SYSTEM FOR OPENING AND CLOSING THE ROOF PANEL

FIELD OF THE INVENTION

The present invention relates to a roof panel and control system for opening and closing the roof panel.

BACKGROUND OF THE INVENTION

Roof panels which can be opened and closed find uses in a wide variety of structures. For example, such roof panels may be used to form the roofs of prefabricated meeting rooms that are assembled inside of larger rooms of a building. Such meeting rooms are sometimes referred to as pods, and may be used to provide quiet areas for private discussions inside of open plan offices.

Roof panels for pod rooms are typically closed during meetings to provide sound proofing, however need to open when there is an emergency, to allow the sound of emergency alarms to be heard inside the pod and to allow water from sprinkler systems to enter the pod through the pod roof.

Various types of roof panels for pod roofs are known, which aim to allow opening of pod roofs under emergency conditions. Some systems rely on mechanical biasing of the roof towards an open position; however these can be prone to jamming or failure of springs as the roof panel ages. Other systems use mains power which is not reliable under emergency conditions, or battery power which is not reliable after many cycles when the battery becomes discharged and/or no longer recharges properly anymore.

It is therefore an object of the invention to provide a more reliable roof panel.

SUMMARY OF THE INVENTION

According to the invention, there is provided an apparatus comprising a roof panel and control system. The roof panel comprises one or more cover portions that are moveable between open and closed positions for opening and closing the roof panel. The control system comprises an actuator for moving the cover portions between the open and closed positions, a mains power supply input, and an emergency power store. The control system is configured to receive one or more signals indicative of an emergency, to power the actuator from the mains power supply when the signals indicate there is no emergency, and to power the actuator from the emergency power store when the signals indicate there is an emergency.

Therefore, the mains power supply is used when there is no emergency, saving the emergency power store from being used. Then, when there is an emergency, the emergency power store is still in good condition and can be relied upon to open the roof. Preferably, the control system only powers the actuator from the emergency power store when the signals indicate there is an emergency, so the emergency power store is not used at all unless essential. Accordingly, the control system may always power the actuator from the mains power supply when the signals indicate there is no emergency.

The emergency power store may be a battery of the control system, although other electrical power storage technologies such as supercapacitors or fuel cells could alternatively be used for the emergency power store.

Most battery technologies result in batteries that self-discharge to some extent over time, and so to help combat this the emergency power store may be a rechargeable battery, and the control system may be configured to recharge the rechargeable battery from the mains power supply.

To ensure the battery always has sufficient charge stored within it, the control system may be configured to monitor a voltage of the emergency power store, and issue an alert if the voltage falls below a threshold. The alert is intended to alert user(s) of the roof panel that the roof requires maintenance, and may for example take the form of a flashing light or audible alarm. Preferably, the cover portions of the roof panel are moved to the open position when the alert is issued, and remain there until the voltage is restored to a level above the threshold, regardless of the mains power supply.

The control system may comprise an emergency input for receiving the signals indicative of an emergency, for example from a fire alarm system or evacuation alert system. Optionally, the mains power supply may be one of the signals, and the control system may determine that there is an emergency when the mains power supply fails, i.e. when no power is received from it.

Preferably, the control system is configured to power the actuator from the emergency battery only when the cover portions are moved from the closed to the open positions, and not from the open positions to the closed positions. Accordingly, the emergency power store is saved for use in emergencies when the cover portions need to be opened to allow the sound of alarm(s) to pass into the pod and water from sprinklers to enter.

The control system may comprise a user-actuable control point, and the control system may power the actuator to move the cover portions to the open positions when the user-actuable control point is actuated by a user. Therefore, a user can actuate the control point to open the cover portions and therefore the roof panel whenever they wish to increase ventilation in the meeting room. The control system may power the actuator from the mains power supply to move the cover portions to the closed positions a preset length of time after actuation of the user-actuable control point by a user, so the cover portions revert to the closed positions. In some embodiments, the preset length of time may be set by the user when actuating the control point, or may be set by an administrator of the system. The closed positions are the default positions of the cover portions, so that the pod provides soundproofing for meetings without any action needing to be taken at the start of the meeting. Optionally, the user-actuable control point may include a switch or button that the user can press to close the roof before the preset length of time has expired, for example if the user desires soundproofing rather than ventilation at any particular time.

The cover portions may for example comprise a plurality of slats which are rotatable to open and close the roof panel, for example under control of an electric motor actuator. Each slat may comprise a sound insulation layer and a support layer on which the sound insulation layer is mounted. The sound insulation layer helps prevent sound from travelling via the roof panel when the slats are closed, for example during meetings.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
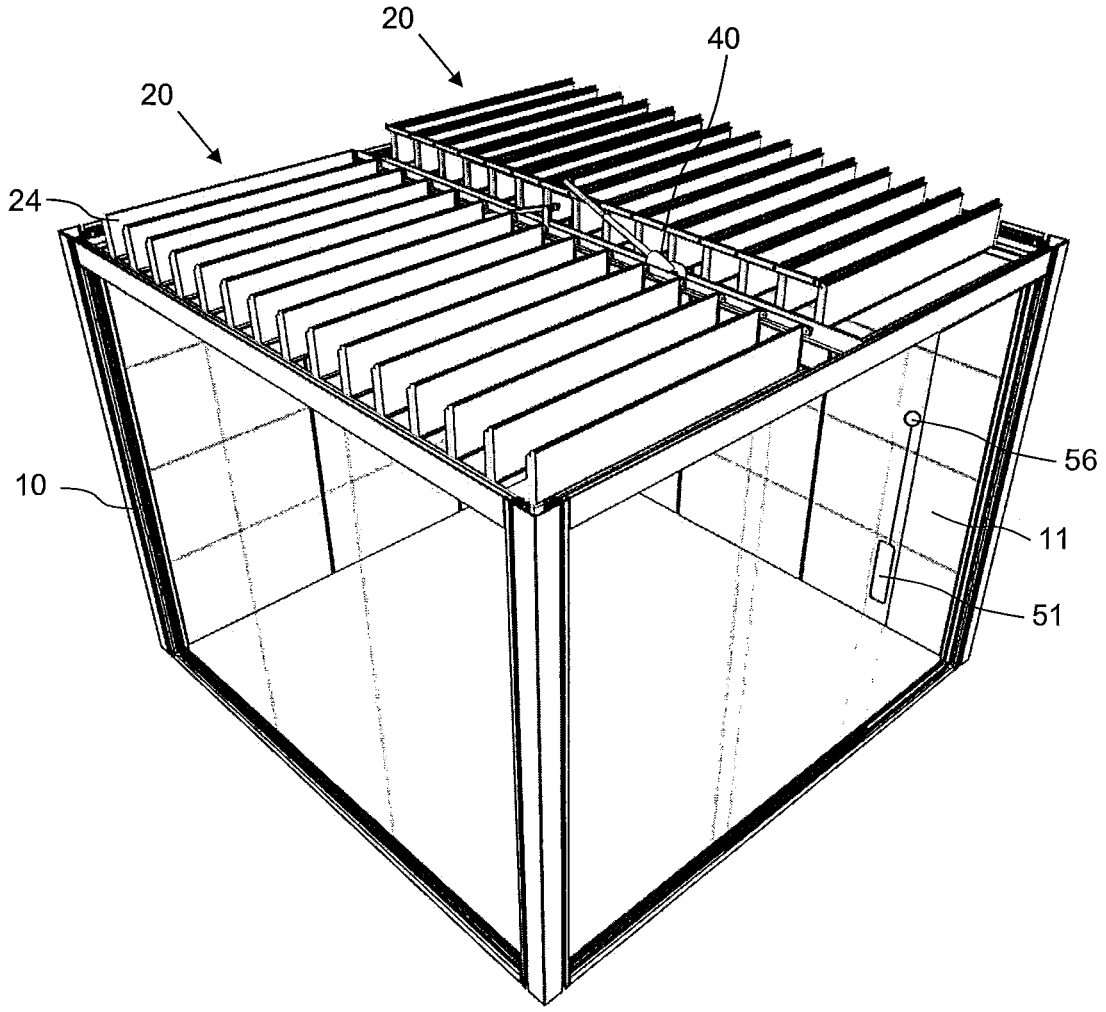
FIG. 1 shows a schematic diagram of a pod with roof panels and a control system according to an embodiment of the invention.

The schematic diagram of FIG. 1 shows a pod 10 for fitting inside of an open plan office. The pod has four walls, two of which are transparent, and has two roof panels 20 that are mounted above the walls and together form a roof of the pod 10. The roof of the pod 10 is shown in an open configuration, with a plurality of cover portions in the form of slats 24. The slats 24 are shown positioned vertically to provide a series of elongate holes through the roof in between adjacent ones of the slats 24. As will be described in more detail further below, the slats 24 can be moved to horizontal positions in which they close the elongate holes through the roof.

A controller 51 of a control system for controlling the opening and closing of the slats 24 is mounted on wall 11 of the pod. A user-actuable control point in the form of a push button 56 is also mounted on the wall 11, and is connected to the controller 51. The controller 51 is configured to open the roof for a preset length of time whenever the push button 51 is pushed by a user of the pod 10. In this embodiment, the preset length of time is 20 minutes, however the preset length of time can be altered at the controller 51 if desired.

Figure 2:
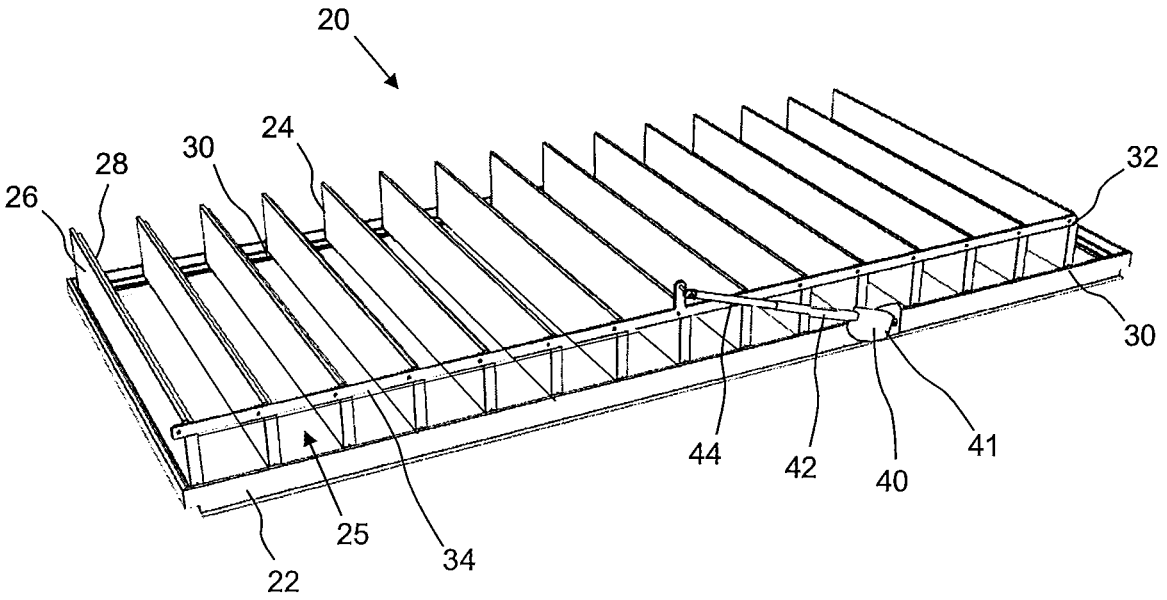
FIG. 2 shows a schematic diagram of one of the roof panels of the FIG. 1 pod room in an open configuration.

The schematic diagram of FIG. 2 shows a more detailed view of one of the roof panels 20 of the pod 10. The roof panel is shown in the open configuration, with the slats 24 arranged vertically. Elongate holes 25 are between the slats 24 and pass right through the roof panel 20. The roof panel 20 comprises a rectangular frame 22 with each slat 24 spanning across the width of the rectangular frame. Each slat 24 comprises an aluminium support layer 26 and a sound insulation layer 28 on the aluminium support layer 26 to provide soundproofing.

Figure 3:
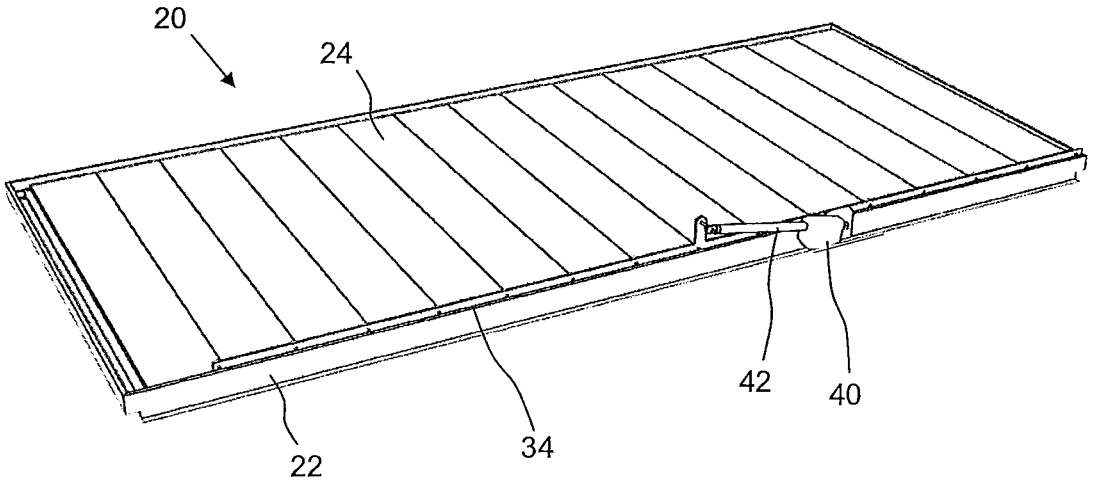
FIG. 3 shows a schematic diagram of the roof panel of FIG. 2 in a closed configuration.

Each slat 24 has a rectangular shape with both its bottom corners 30 pivotally connected to the frame 22, and one of its top corners 32 pivotally connected to a push rod 34. The push rod 34 is perpendicular to the slats 24, and is connected to an actuator 40 which moves the push rod 34 to open and close the slats. For example, the schematic diagram of FIG. 3 shows the slats 24 orientated-horizontally in a closed configuration when the actuator 40 has moved the push rod 34 downwardly and to the right, to close the elongate openings 25 with the slats 24 and therefore close the roof panel.

The actuator 40 comprises an electric motor within body 41, and a shaft 44 which is movable in and out of a sheath 42 under control of the electric motor. For example, the sheath 42 may comprise an internal screw thread that co-operates with an external screw thread of the shaft 44, such that rotating the sheath 42 with the electric motor causes the shaft 44 to move in and out of the sheath 42. The shaft 44 is pivotally connected to the push rod 34, such that moving the shaft 44 in and out of the sheath 42 closes and opens the roof panel. Other alternate arrangements for extending and retracting the shaft 44 from the sheath 42 will also be apparent to those skilled in the art. For example, the actuator 40 could be implemented as a stepper motor which rotates the body 41 and sheath 42/shaft 44 to move the push rod 34.

Figure 4:
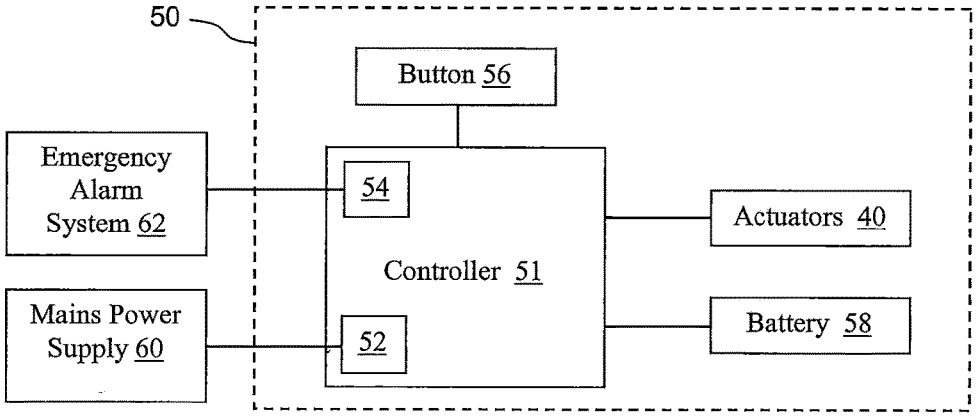
FIG. 4 shows a schematic block diagram of the control system of the pod of FIG. 1.

The schematic diagram of FIG. 4 shows the control system for controlling the opening and closing of the roof panels 20. Specifically, the control system 50 comprises the controller 51 connected to the button 56 and the actuators 40 of the roof panels 20. The control system also comprises an emergency power store in the form of a rechargeable battery 58 that is connected to the controller 51.

The controller 51 comprises a mains power input 52 in the form of a mains electricity plug that is plugged into a mains power supply 60. The controller 51 also comprises an emergency input 54 in the form of a socket that receives a plug of an emergency alarm system 62. In this embodiment, the emergency alarm system 62 is a smoke/heat detector, although other types of emergency alarm system will be apparent to those skilled in the art.

The controller 51 monitors the voltage of the battery 58, and periodically recharges it from the mains power supply. If the voltage of the battery 58 ever drops below a threshold value, then the controller 51 issues an alert in the form of a flashing light, indicating that the battery 58 requires maintenance.

Figure 5:
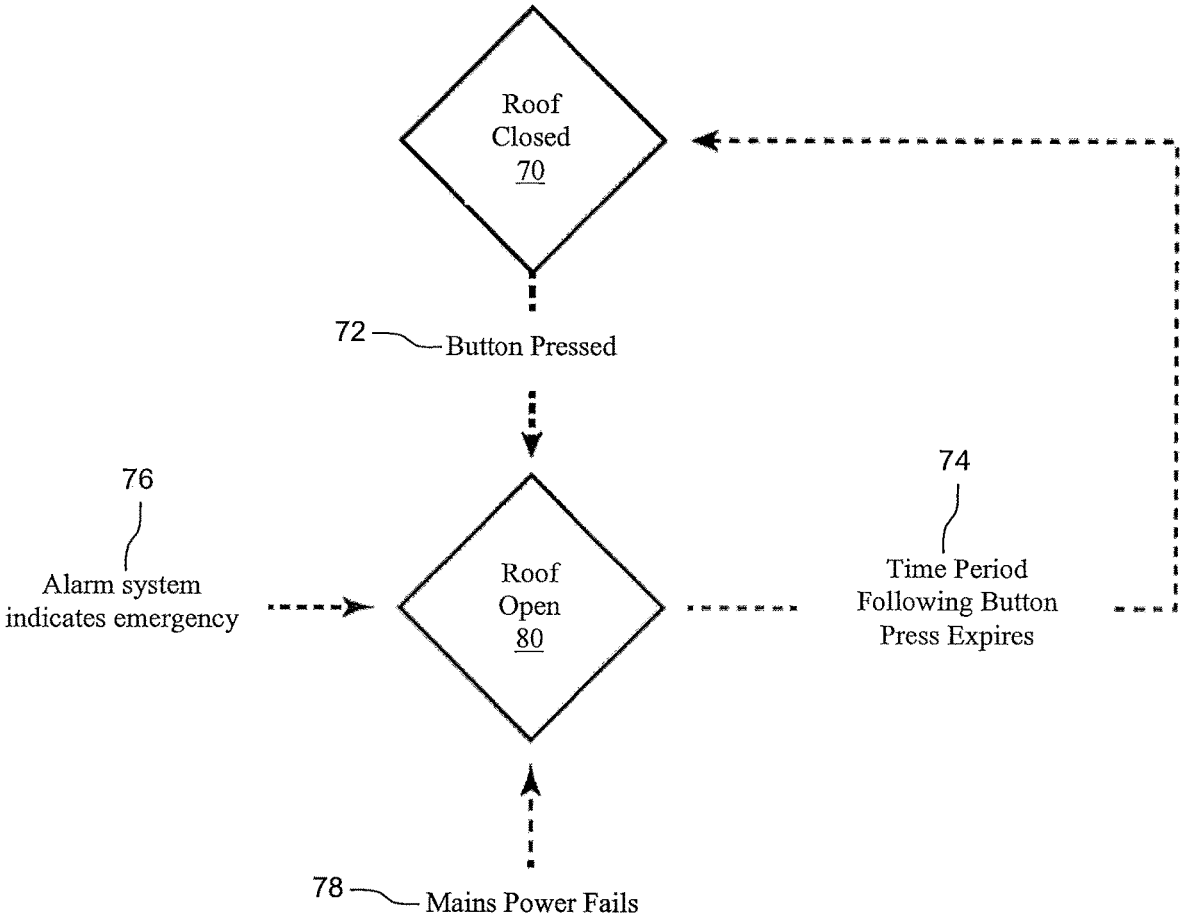
FIG. 5 shows a flow diagram of the use of the roof panels and control system of FIG. 1.

The controller 51 controls the opening and closing of the roof panels 20 by actuating the actuators 40 in accordance with signals received from the emergency alarm system 62, the mains power supply 60, and the button 56. The flow diagram of FIG. 5 shows how the controller controls the roof panels based on those signals, as will now be described.

Starting from a state 70 when the roof panels 20 are closed, one or more users enter the pod 10 and decide that they would like to increase the ventilation within the pod to provide cooling. Therefore the user(s) press the button 56 in a step 72. The controller 51 receives the button press, and in response powers the actuators 40 to rotate the slats 24 of the roof panels 20 to their open positions in state 80, so that air can flow through the elongate apertures 25 through the roof panels. Since the emergency alarm system 62 does not indicate an emergency, the actuators 40 are powered from the mains power supply 60. A timer of the controller 51 starts counting up to the preset length of time, which is set at 20 minutes.

After 20 minutes, the timer expires at step 74, and in response the controller 51 powers the actuators 40 to rotate the slats 24 back to their closed positions so that the elongate apertures 25 are closed and the slats 24 provide soundproofing for the meeting. Since the emergency alarm system 62 does not indicate an emergency and the slats are being closed rather than opened, the actuators 40 are powered from the mains power supply 60. By this time, the pod has cooled down sufficiently, and so the user(s) are happy for the pod roof to remain closed. In the event it becomes too hot inside the pod again, the user(s) simply press the button 56 again to provide another 20 minute time period with the roof open. In an alternate embodiment, the user-actuable control point comprises a slider in addition to the button 56, and the user(s) can move the slider to set how long the roof is to remain open for. The user-actuable control point may also include a switch or button that the user can press to close the roof before the 20 minute time period time has expired, for example if the user desires soundproofing rather than ventilation at any particular time.

In a step 76, the emergency alarm system 62 detects that there is a fire in the office building, and the controller 51 receives a signal from the emergency alarm system at the emergency input 54, the signal indicating that there is an emergency. In response, the controller 51 powers the actuators 40 to move the slats 24 to their open positions where the elongate apertures 25 are opened. Since the signal from the emergency alarm system indicates an emergency, the actuators 40 are powered to open the slats using power from the emergency power store 58, rather than from the mains power supply. Therefore, even if the mains powers supply fails as a result of the emergency, the slats will still be moved to the open positions.

Once the roof has been opened, the user(s) inside the pod hear an alarm of the emergency alarm system 62 through the elongate apertures 25, and leave the building. Water from sprinklers of the emergency alarm system 62 may also enter the pod 10 through the elongate apertures 25. Once the emergency has passed and the signal at the emergency input 54 no longer indicates an emergency, the button 56 can be pressed once to reset the system and return the roof to the closed configuration.

In this particular embodiment, the controller 51 also treats the failure of the mains power supply as an emergency. Therefore, if the mains power supply fails at step 78, then the controller 51 powers the actuators 40 to move the slats 24 to their open positions using the emergency power store 58. Once the mains power returns and no emergency is indicated by the emergency alarm system 62, the controller 51 powers the actuators 40 from the mains power supply to return the slats 24 to their default closed positions.

It will be appreciated that the controller 51 could be implemented in any suitable manner, for example by hardwiring, or by a microcontroller, or a computer program running on a processor.

Many other variations of the described embodiments falling within the scope of the invention will also be apparent to those skilled in the art.

The invention claimed is:

1. An apparatus comprising a roof panel and control system, the roof panel comprising one or more cover portions that are moveable between open and closed positions for opening and closing the roof panel, the control system comprising an actuator for moving the cover portions between the open and closed positions, a mains power supply input, and an emergency power store, wherein the control system is configured to receive one or more signals indicative of an emergency, to power the actuator from the mains power supply input when the signals indicate there is no emergency, and to power the actuator from the emergency power store when the signals indicate there is an emergency, wherein the control system is configured to monitor a voltage of the emergency power store, to automatically move the cover portions to the open position if the voltage falls below a threshold, and to keep the cover portions in the open position for as long as the voltage remains below the threshold.

2. The apparatus of claim 1, wherein the control system comprises an emergency input for receiving the signals indicative of an emergency.

3. The apparatus of claim 1, wherein the mains power supply input is one of the signals, and wherein the mains power supply input is considered by the control system to indicate an emergency when no power is received from it.

4. The apparatus of claim 1, wherein the actuator is an electric actuator which electrically powers the movement of the cover portions from the open to the closed positions, and from the closed to the open positions.

5. The apparatus of claim 1, wherein the control system is configured to power the actuator from the emergency power store to move the cover portions to the open positions when the signals indicate there is an emergency.

6. The apparatus of claim 1, wherein the cover portions comprise a plurality of slats which are rotatable to open and close the roof panel.

7. The apparatus of claim 6, wherein each slat comprises a sound insulation layer and a support layer on which the sound insulation layer is mounted.

8. The apparatus of claim 1, wherein the emergency power store is a rechargeable battery, and wherein the control system is configured to recharge the rechargeable battery from the mains power supply input.

9. The apparatus of claim 1, wherein the control system comprises a controller that receives the one or more signals indicative of an emergency, and controls the powering of the actuator from the mains power supply input and emergency power store.

10. An apparatus comprising a roof panel and control system, the roof panel comprising one or more cover portions that are moveable between open and closed positions for opening and closing the roof panel, the control system comprising an actuator for moving the cover portions between the open and closed positions, a mains power supply input, and an emergency power store, wherein the control system is configured to receive one or more signals indicative of an emergency, to power the actuator from the mains power supply input when the signals indicate there is no emergency, and to power the actuator from the emergency power store when the signals indicate there is an emergency, wherein the control system is configured to power the actuator from the emergency power store only when the cover portions are moved from the closed to the open positions, and never when the cover portions are moved from the open to the closed positions.

11. The apparatus of claim 10, wherein the control system comprises an emergency input for receiving the signals indicative of an emergency.

12. The apparatus of claim 10, wherein the mains power supply input is one of the signals, and wherein the mains power supply input is considered by the control system to indicate an emergency when no power is received from it.

13. The apparatus of claim 10, wherein the actuator is an electric actuator which electrically powers the movement of the cover portions from the open to the closed positions, and from the closed to the open positions.

14. The apparatus of claim 10, wherein the control system is configured to power the actuator from the emergency power store to move the cover portions to the open positions when the signals indicate there is an emergency.

15. An apparatus comprising a roof panel and control system, the roof panel comprising one or more cover portions that are moveable between open and closed positions for opening and closing the roof panel, the control system comprising an actuator for moving the cover portions between the open and closed positions, a mains power supply input, and an emergency power store, wherein the control system is configured to receive one or more signals indicative of an emergency, to power the actuator from the mains power supply input when the signals indicate there is no emergency, and to power the actuator from the emergency power store when the signals indicate there is an emergency, wherein the control system comprises a user-actuable control point, and wherein the control system powers the actuator to move the cover portions to the open positions when the user-actuable control point is actuated by a user, wherein the control system is configured to power the actuator to move the cover portions to the closed positions a preset length of time after actuation of the user-actuable control point by a user, wherein the control system comprises a slider which is slidable to set the preset length of time.

16. The apparatus of claim 15, wherein the user-actuable control point comprises a button which is actuable to power the actuator to move the cover portions to the open positions, and the user-actuable control point further comprises the slider.

* * * * *